US005930876A

United States Patent [19]

Takizawa et al.

[11] Patent Number: 5,930,876

[45] Date of Patent: Aug. 3, 1999

[54] BIODEGRADABLE SEPARABLE FASTENER AND METHOD FOR PRODUCTION THEREOF

[75] Inventors: Toshiaki Takizawa, Kurobe; Tsuyoshi Minato, Toyama, both of Japan

[73] Assignee: YKK Corporation, Tokyo, Japan

[21] Appl. No.: 09/109,141

[22] Filed: Jul. 2, 1998

Related U.S. Application Data

[62] Division of application No. 08/866,317, May 30, 1997.

[30] Foreign Application Priority Data

May 31, 1996 [JP] Japan ..... 8-159135

[51] Int. Cl.[6] ..... A44B 13/00

[52] U.S. Cl. ..... 24/452; 24/442

[58] Field of Search ..... 24/452, 442, 450, 24/390

[56] References Cited

U.S. PATENT DOCUMENTS

| | | | |
|---|---|---|---|
| 3,469,289 | 9/1969 | Whitacre | 24/442 |
| 4,307,496 | 12/1981 | Nakagaki et al. . | |
| 4,510,656 | 4/1985 | Yoshida et al. | 24/390 |
| 4,709,562 | 12/1987 | Matsuda | 24/452 |
| 4,870,721 | 10/1989 | Cohen . | |
| 5,067,210 | 11/1991 | Kayaki | 24/452 |
| 5,212,853 | 5/1993 | Kaneko | 24/452 |
| 5,345,659 | 9/1994 | Allan | 24/442 |
| 5,360,270 | 11/1994 | Appeldorn et al. . | |
| 5,382,462 | 1/1995 | Pacione . | |
| 5,586,408 | 12/1996 | Bergevin . | |
| 5,620,769 | 4/1997 | Wessels et al. | 24/452 |
| 5,624,427 | 4/1997 | Bergman et al. | 24/442 |
| 5,634,245 | 6/1997 | Rouser et al. . | |

FOREIGN PATENT DOCUMENTS

| | | | |
|---|---|---|---|
| 31 13 020 A1 | 11/1982 | Germany . | |
| 195 36 409 A1 | 4/1996 | Germany . | |
| 4279103 | 10/1992 | Japan | 24/452 |

*Primary Examiner*—Victor N. Sakran
*Attorney, Agent, or Firm*—Hill & Simpson

[57] ABSTRACT

Disclosed are a biodegradable separable fastener which can be appropriately used as a fastening means for disposable products and a method for the production thereof. In a separable fastener composed of a base part and a multiplicity of engaging elements raised from the obverse side of the base part, the base part and the engaging elements are formed of a biodegradable resin. In a favorable mode, at least the base part of the separable fastener has such a sectional shape as to increase the specific surface area. For example, grooves and/or holes are formed in the base part or holes are extended from the reverse side of the base part to the interiors of the engaging elements. The biodegradable separable fastener having such grooves and/or the holes may be manufactured by forming at least part of the base part with a water-soluble resin and the other part of the fastener with a biodegradable resin and, after the manufacture of the separable fastener, causing the water-soluble resin to dissolve out into a solvent.

18 Claims, 9 Drawing Sheets

BIODEGRADABLE SEPARABLE FASTENER AND METHOD FOR PRODUCTION THEREOF

This is a divisional of application Ser. No. 08/866,317, filed May 30, 1997.

BACKGROUND OF THE INVENTION

1. Field of the Invention

This invention relates to a biodegradable separable fastener of the hook-and-loop type, male-and-female type, hook-to-hook type or other type (hereinafter referred to generally as "separable fastener") and a method for the production thereof and more particularly to a biodegradable separable fastener which can be appropriately used as a fastening means for disposable products.

2. Description of the Prior Art

In recent years, the problem of disposal of plastics waste has come to attract attention from the viewpoint of conservation of the earth's environment and the demand for the development of a technology for waste disposal has been gaining in enthusiasm. As one of the targets of the development, the biodegradable plastics to be incorporated in the circulation of matter in the natural world have been arresting attention.

The biodegradable resinous materials which are disintegrated on exposure to the microbial action in soil or in water are known in various kinds such as (a) the microbial fermentative production type, (b) starch alloy type, (c) chemical synthesis type, and (d) polylactic acid type. The development of these biodegradable resinous materials for use in such containers as bottles, cups, and trays besides wrapping films and bags is now under way.

No case of applying a biodegradable resin to the separable fastener which is the object of the present invention, however, has been known to the art.

Generally, the separable fastener requires such durability as withstands repeated use. The products of the kind necessitating the separable fastener generally are not intended as disposable articles. The separable fasteners marketed heretofore, therefore, have been invariably manufactured with a general-purpose resinous material.

SUMMARY OF THE INVENTION

Even in the field requiring use of separable fasteners, however, the development of separable fasteners for use in such disposable products as tying bands, covers for preventing seedlings from being devoured by deers and other animals, and covers for nursing mushrooms has been advancing in recent years. The separable fasteners are being used for joining ends of these products. As respects diapers, disposable products which are made of water-soluble resins have been developed recently. Likewise, separable fasteners are being used for joining main bodies of diapers.

Accordingly, the necessity for developing a separable fastener which, when used in such a disposable product as mentioned above, has no possibility of retaining shape intact over many years and forming one cause for destruction of the earth's environment or inducing the nuisance of the waste has been finding recognition.

The basic object of the present invention, therefore, is to provide a biodegradable separable fastener which poses no such problem as mentioned above and, after fulfilling the purpose thereof, undergoes degradation by the action of microorganisms in soil or in water as quickly as possible.

Another object of the present invention is to provide a separable fastener which possesses relatively high durability enough to warrant repeated use and has such structure as to be quickly disintegrated by the action of microorganisms.

A further object of the present invention is to provide a method which permits the biodegradable separable fastener described above to be manufactured with high productivity at a relatively low cost.

To accomplish the objects mentioned above, the basic mode of the present invention provides a separable fastener which is composed of a base part and a multiplicity of engaging elements raised from the obverse side of the base part and characterized by the base part and the engaging elements being formed of a biodegradable resin.

In a favorable mode permitting quick degradation by the action of microorganisms, at least the base part of the separable fastener has such a sectional shape as to increase the specific surface area. In a particularly favorable mode, grooves and/or holes are formed in at least the base part or holes are extended from the reverse side of the base part to the interiors of the engaging elements.

The grooves and/or the holes mentioned above may be formed by molding or they may be formed by dissolving out a water-soluble resin from the fastener.

The present invention further provides a method for the production of the biodegradable separable fastener mentioned above. In a favorable mode of the present invention which resides in a method for the production of a separable fastener composed of a base part and a multiplicity of engaging elements raised from the obverse side of the base part, which method is characterized by forming at least part of the base part with a water-soluble resin and the other part of the fastener with a biodegradable resin and, after the manufacture of the separable fastener, causing the water-soluble resin to dissolve out into a solvent and consequently allowing at least the base part to assume such a sectional shape as to produce a large specific surface area.

Another advantageous method for the production of a separable fastener is characterized by forming the parts intended to form grooves and/or holes with a water-soluble resin and, after the manufacture of the separable fastener, causing the water-soluble resin to dissolve out into a solvent thereby giving shape to the grooves and/or the holes.

By these methods of the present invention for the production of a separable fastener, a biodegradable separable fastener manifesting durability enough to withstand repeated use and high flexibility and engaging force and having grooves and/or holes formed therein is manufactured with high productivity at a relatively low cost.

BRIEF DESCRIPTION OF THE DRAWINGS

The other objects, features, and advantages of the present invention will become apparent from the following description taken together with the accompanying drawings, in which.

DETAILED DESCRIPTION OF THE INVENTION

Figure 1:
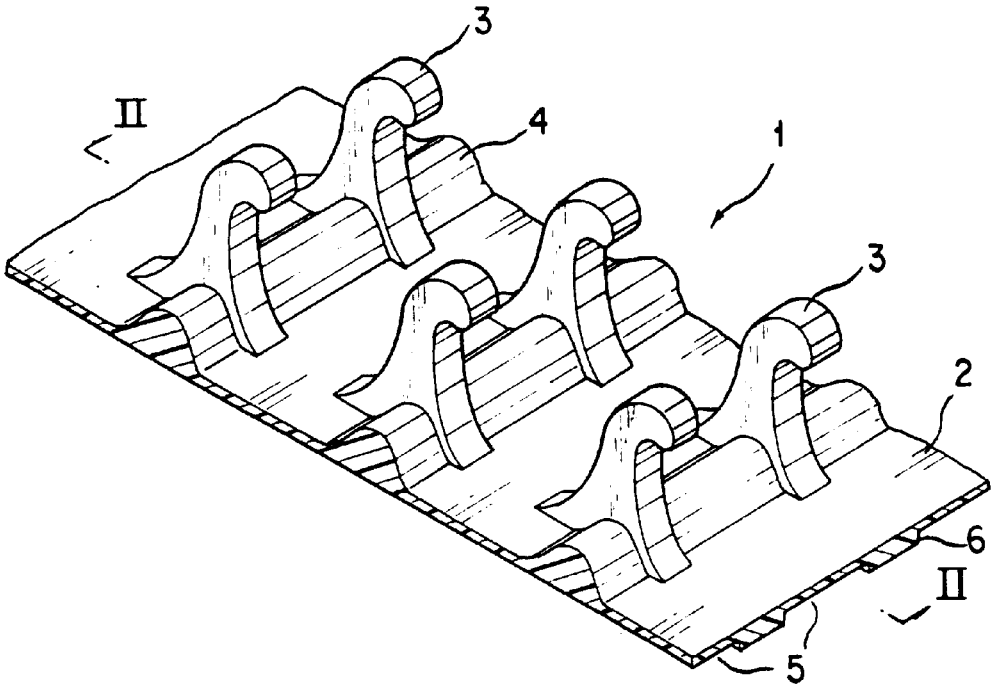
FIG. 1 is a partial perspective view of a male fastener member of a biodegradable separable fastener as the first embodiment of the present invention.

The separable fastener of the present invention can be disintegrated by the action of microorganisms because the base part and the multiplicity of engaging elements raised from the obverse side of the base part are formed of a biodegradable resin. Even when the disposable products such as, for example, tying bands, covers for seedlings, covers for nursing mushrooms, and diapers which are made of a biodegradable resin or a water-soluble resin and use the separable fastener of the present invention in their joined parts are discarded after use, they have no possibility of destroying the earth's environment or causing nuisance of waste because they are disintegrated by the action of microorganisms in soil or in water or they are completely dissolved as by rainwater. Further, since the products made of biodegradable resins are reduced in the form of compost to the earth, they have no possibility of turning into scattered debris like those of ordinary plastic products and doing harm to wild animals. The fact that these products lose volume in consequence of the degradation results in elongating the life of a landfill or stabilizing the condition of the landfill. Further, when these products are disposed of by incineration, since the biodegradable resin emits a small amount of heat during the incineration, the possibility of the combustion thereof doing harm to the incinerator is reduced.

Incidentally, the disposable products, notwithstanding the name, are often discarded after they have been repeatedly used many times on account of economy.

From the viewpoint of conserving the earth's environment and preventing the nuisance of waste disposal, products which are not disposable are expected to use the biodegradable separable fastener.

In these cases, the separable fastener is required from the viewpoint of function to possess durability enough to warrant ample engaging force in spite of the repeated use. Since the engaging elements of the separable fastener are small or slender, they are rather smoothly biodegraded by microorganisms. In contrast, the base part is not very easily biodegraded because it has an appreciable thickness. If the base part is formed in a smaller thickness, it will be more easily biodegraded by microorganisms and nevertheless will be disimproved in durability and strength.

In the preferred mode of the present invention, the separable fastener has at least the base part thereof formed in a cross-sectional shape such that the specific surface area thereof may be increased. For this purpose, grooves and/or holes are formed in at least the base part or holes are extended from the reverse side of the base part through the interiors of the engaging elements, for example. The term "hole" as used in this specification should be construed as a concept which embraces both a through hole and a blind hole (or depression). In the base part having the shape of a flat plate, the formation of a coarse surface thereon is one of the effective means for increasing the specific surface area. The grooves and/or holes formed in the base part can also be referred to as recesses in the base part, such as recesses that extend from an outer surface of the base part into the base part. The recesses (i.e., grooves and/or holes) increase the surface area of the base part.

By increasing the specific surface area of the base part of the separable fastener as described above, the separable fastener is enabled to secure ample durability and strength and meanwhile promote the degradation of the base part by the action of microorganisms. By forming the grooves and/or the holes in the base part, the separable fastener is allowed to confer flexibility on the base part and, by virtue of ready deformation of the base part, effect quick engagement between the engaging elements and improve the engaging force as expected.

The production of the separable fastener of the present invention can be effected by any of the various methods heretofore known to the art, excepting the materials to be used therein are biodegradable resins as mentioned above. The separable fastener is not particularly limited in shape. The male fastener member of the separable fastener, for example, may be produced from a biodegradable resin by integrally molding the base part with variously shaped engaging elements, such as engaging elements shaped like hooks, engaging elements containing hemispherical head parts, and engaging elements containing conical head parts, which are raised from the base part. It may be otherwise produced by forming a base fabric manufactured by weaving or knitting biodegradable resin fibers so as to be provided with loops raised from the base fabric and cutting the loops thereby converting them into hooks. The structure of the male fastener member is not limited to a specific one. The female fastener member of the separable fastener may be produced by manufacturing a biodegradable resin fibers into a pile woven or knitted fabric containing loops, into a woven or knitted fabric raised so as to form a multiplicity of loops on the surface thereof, or into non-woven fabric. Any type of the female fastener may be used so long as it is invariably capable of allowing the engaging elements of the male fastener member to be engaged therewith. Further, by shaping the head parts of the engaging elements so as to project hook parts in opposite sides or in numerous directions, the separable fastener enables the hook parts to engage mutually and functions concurrently as a male member and a female member.

To be used as the material for the production of the separable fastener of the present invention, the biodegradable resin is required to manifest moldability and proper flexibility and hardness and possess an ability to yield to degradation by the action of microorganisms. As concrete examples of the resin, microbial fermentative production type resins such as a copolymer of hydroxybutyric acid with hydroxyvaleric acid (produced by Zeneka K.K. and marketed under trademark designation of "Biopol"), natural macromolecular (starch) type resins such as a blend of starch with modified polyvinyl alcohol (produced by Nippon Synthetic Chemical Industry Co., Ltd. and marketed under trademark designation of "Mater-Bi"), and a blend of starch with a biodegradable synthetic polymer (produced by Werner Lambert Corp. of U.S. and marketed under trademark designation of "Novon") and chemical synthetic resins, such as polylactic acid, aliphatic polyester (produced by Showa Highpolymer Co., Ltd. and marketed under trademark designation of "Bionolle") and polycaprolactone (produced by Daicel Chemical Industry K.K. and marketed under trademark designation of "Praccel") may be cited.

As the water-soluble resin to be used for the formation of the grooves and/or the holes in the separable fastener, any resin may be used effectively so long as it possesses a hydrophilic group such as hydroxyl group, carboxylic group, or sulfonic acid group, exhibits solubility in water, and manifests moldability. As concrete examples of the material, polyvinyl alcohol, modified polyvinyl alcohol, polyacrylic acid, polyethylene oxide, CMC (carboxymethylcellulose), and gum a may be cited. Among other materials enumerated above, the modified polyvinyl alcohol (such as, for example, the graft of a polyoxyalkylene to a vinyl alcohol-allyl alcohol copolymer produced by Nippon Synthetic Chemical Industry Co., Ltd. and marketed under trademark designation of "Ecomaty AX") can be used particularly advantageously.

Now, the various modes of the biodegradable separable fastener of the present invention and the method for production thereof will be described specifically below with reference to the embodiments illustrated in the accompanying drawings.

Figure 2:
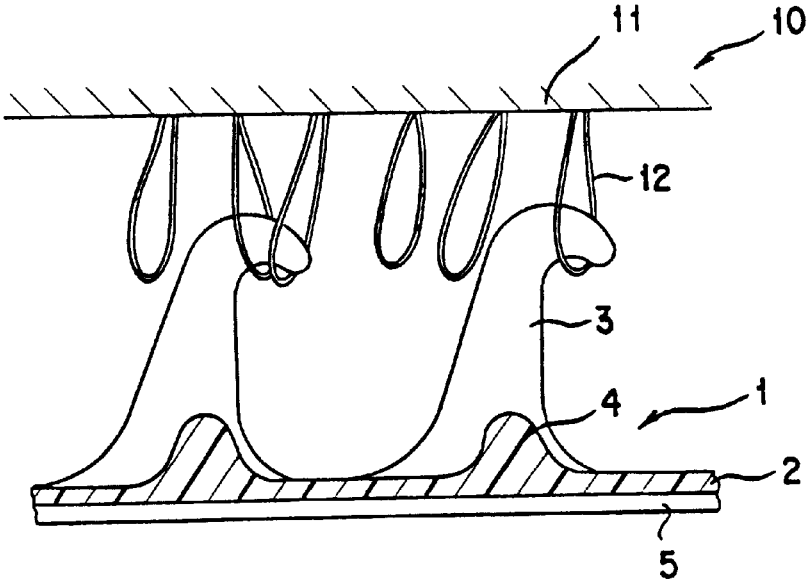
FIG. 2 is a fragmentary cross section illustrating the state of engagement between the biodegradable male fastener member shown in FIG. 1 and a biodegradable female fastener member with the male fastener member showing a cross section thereof taken through FIG. 1 along the line II—II.

FIG. 1 and FIG. 2 illustrate the separable fastener as the first embodiment of the present invention; FIG. 1 representing a perspective view of a male fastener member 1 and FIG. 2 representing the state of engagement between the male fastener member 1 and a female fastener member 10.

The male fastener member 1 is manufactured by integrally molding the base part 2 and the multiplicity of engaging elements 3 projected from the base part with such a biodegradable resin as mentioned above. The engaging elements 3 are formed astride the reinforcing ribs 4 which are arranged at a prescribed interval in the longitudinal direction of the base part. On the reverse side of the base part 2, the grooves 5 are formed as extended in the longitudinal direction so as to facilitate the degradation of the fastener member by the action of microorganisms and also to ensure retention of proper flexibility and strength. The grooves 5 give rise to longitudinal rib 6 therebetween.

This male fastener member 1 and the female fastener member 10 which have a multiplicity of looped engaging elements 12 projected from the obverse side of a base part 11 manufactured by weaving or knitting fibers are brought into fast engagement by the fact that the hooked engaging element 3 are caught on the looped engaging elements 12 as shown in FIG. 2.

Now, a preferred method for the production of the male fastener member 1 of the first embodiment mentioned above will be described below with reference to FIG. 3 and FIG. 4.

Figure 3:
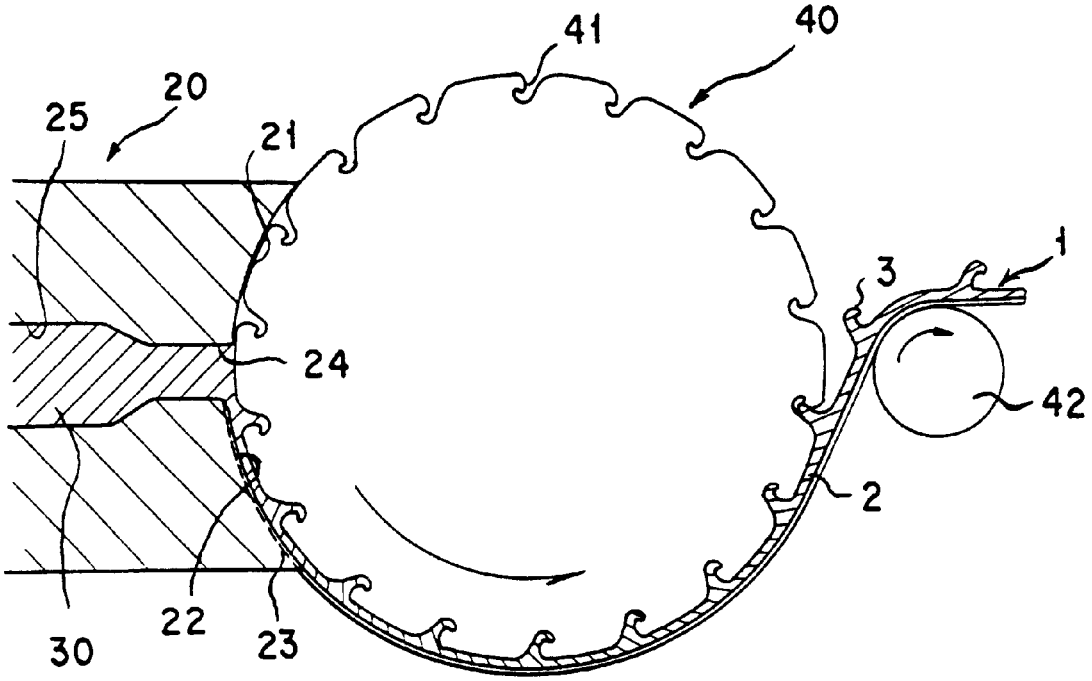
FIG. 3 is a schematic cross section of the essential part of a molding apparatus for the biodegradable male fastener member shown in FIG. 1.
Figure 4:
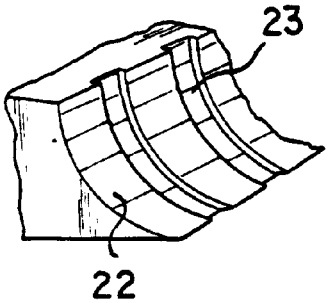
FIG. 4 is a fragmentary perspective view illustrating the lower leading end part of an injection nozzle of the molding apparatus shown in FIG. 3.

FIG. 3 illustrates the essential part of an apparatus for continuous production of a male fastener member. In the diagram, the reference numeral 20 denotes an injection nozzle. The upper half part of the leading end face of the nozzle 20 is formed in the shape of an arced face 21 identical in radius of curvature with a die wheel 40 which will be described specifically herein below. The lower half part of the leading end face of the injection nozzle 20 is formed in the shape of the arced face 22 producing a prescribed gap relative to the curved face of the die wheel 40 and, at the same time, is provided as illustrated in FIG. 4 with the longitudinal grooves 23 which are arranged at a prescribed interval so as to form the longitudinal ribs 6 of the male fastener member 1 mentioned above. This injection nozzle 20 is formed of a T die and is adapted to inject biodegradable molten resin 30 in the form of sheet through an injection orifice 24. In the present embodiment, the injection nozzle 20 is provided along the center thereof with one molten resin flow path 25.

The die wheel 40 has formed on the peripheral face thereof a multiplicity of cavities 41 so shaped as to conform to the engaging elements 3 and the reinforcing ribs 4 of the male fastener member 1. The die wheel 40 is so disposed that the axis thereof may lie parallelly to the injection orifice 24, leaving a prescribed gap between the die wheel 40 and the upper arced face 21 and the lower arced face 22 of the injection nozzle 20.

The structure of the die wheel 40 will be briefly described below. It is shaped like a hollow drum provided on the inside thereof with a water-cooling jacket (not shown). The intermediate part of the die wheel 40 along the axis is formed of a multiplicity of annular plate members which are fixed in a superposed state. On the circumferential faces of the annular plate members, a multiplicity of notches are formed in shapes conforming with those of the hooked engaging elements 3 or the reinforcing ribs 4 of the male fastener member 1 mentioned above. In the die wheel 40, by interposing a prescribed number of annular plate members provided with notches conforming in shape with the reinforcing ribs 4 in such a manner between two annular plate members provided with notches conforming in shape with the hooked engaging elements 3 as to align the notches thereby completing a unit set and then superposing a plurality of such unit sets, the multiplicity of cavities 41 conforming in shape with the engaging elements 3 and the reinforcing ribs 4 of the male fastener member 1 shown in FIG. 1 are formed on the integral peripheral face of the joined unit sets.

The biodegradable molten resin 30 injected from the injection nozzle 20 is forced into the gap formed between the end face of the injection nozzle 20 and the die wheel 40 rotating in the direction of an arrow and part of the spouting molten resin is caused to fill the cavities 41 sequentially and consequently form the hooked engaging elements 3 and the reinforcing ribs 4 and, at the same time, form continuously the platelike base part 2 having prescribed thickness and width.

The molten resin 30 which is kept in contact with the die wheel 40, while being revolved in conjunction with the die wheel 40, is cooled by the water-cooling jacket (not shown) disposed inside the die wheel 40 and gradually solidified. Subsequently, when the male fastener member 1 which has been molded and solidified as described above is reversed at the position of a guide roll 42 and drawn in the same direction as the direction of injection with proper tensile strength, the engaging elements 3 in the cavities 41 mentioned above are smoothly pulled out while being elastically deformed. Thus, the biodegradable male fastener member 1 in an elongate shape as shown in FIG. 1 is continuously manufactured with high productivity. When the cooling effected by the water-cooling jacket disposed inside the die wheel 40 is not sufficient, the lower part of the die wheel 40 is immersed in water to cool directly the fastener member which has been molded.

Figure 5:
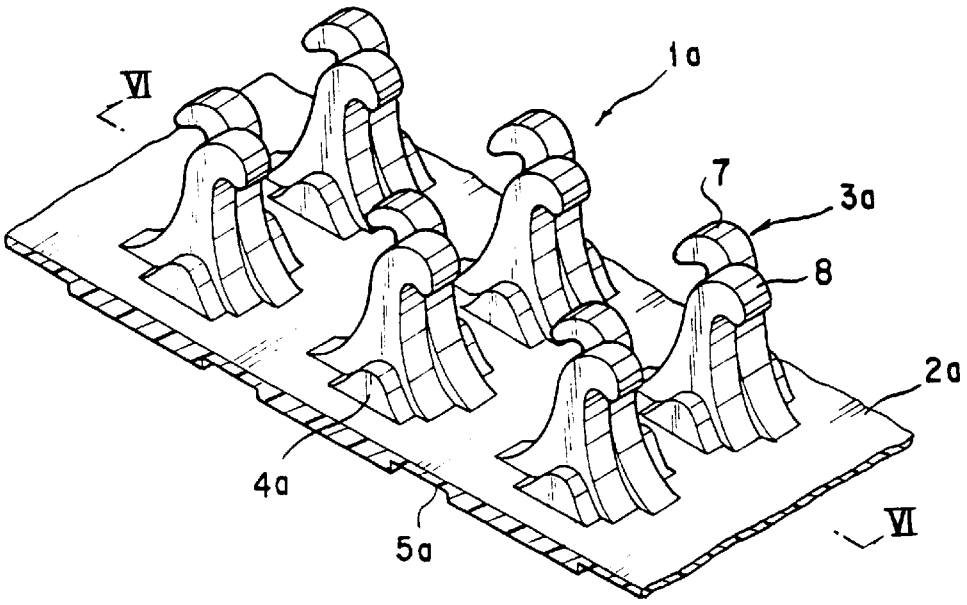
FIG. 5 is a partial perspective view of a biodegradable male fastener member as the second embodiment of the present invention.
Figure 6:
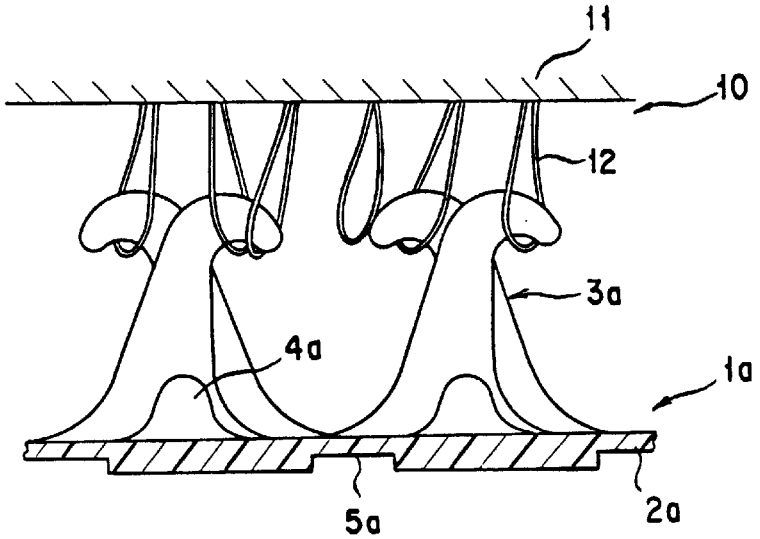
FIG. 6 is a fragmentary cross section illustrating the state of engagement between the biodegradable male fastener member shown in FIG. 5 and a biodegradable female fastener member with the male fastener member showing a cross section thereof taken through FIG. 5 along the line VI—VI.

FIG. 5 and FIG. 6 illustrate the second embodiment of the biodegradable separable fastener of the present invention; FIG. 5 representing a perspective view of the male fastener member 1*a* and FIG. 6 depicting the state of engagement between the male fastener member 1*a* and the female fastener member 10.

The male fastener member 1*a* of the present embodiment differs from that of the first embodiment mentioned above in respect that the engaging elements 3*a* each formed of a pair of adjacent hook pieces 7 and 8 having the hooked leading ends thereof pointed in the mutually opposite directions are raised on the base part 2*a*, that the reinforcing ribs 4*a* are intermittently formed exclusively in the base parts of the relevant engaging members 3*a*, and that the grooves 5*a* are formed in the lateral direction on the reverse side of the base part 2*a* for the purpose of ensuring the formation of a bend in the lateral direction.

The female fastener member 10 has the same structure as that of the first embodiment mentioned above.

Figure 7:
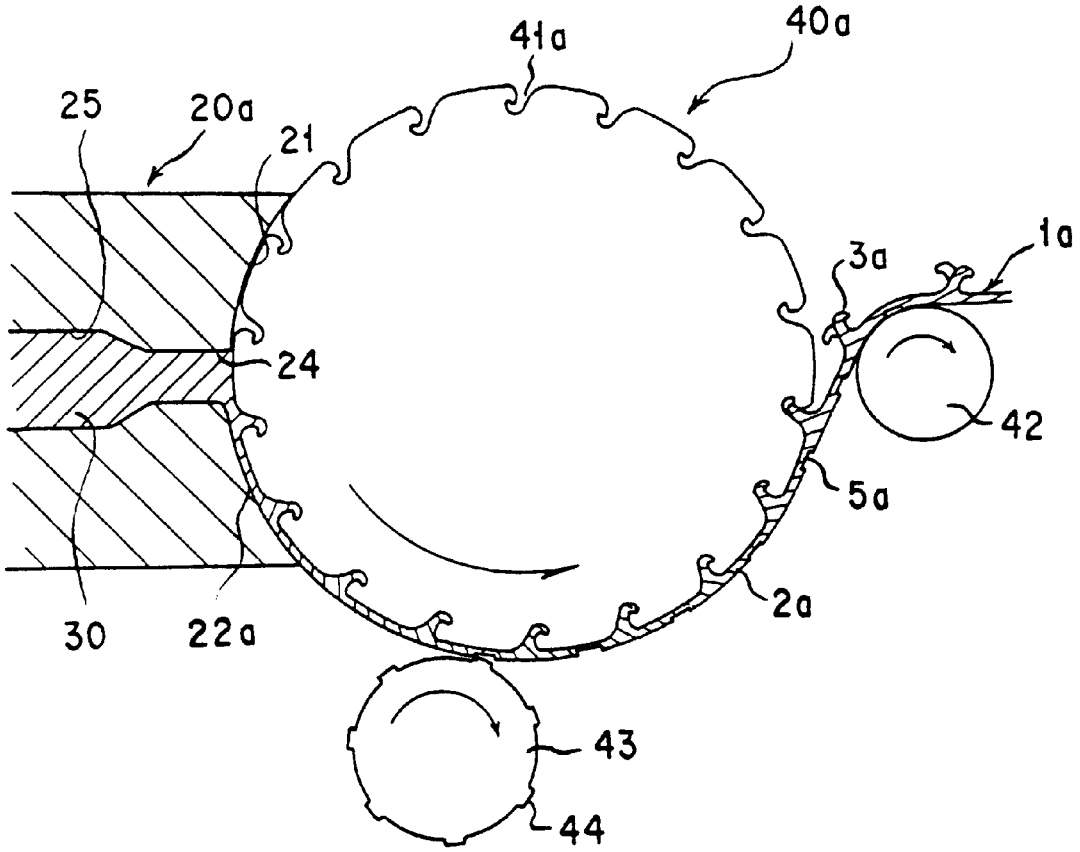
FIG. 7 is a schematic cross section of the essential part of a molding apparatus for the biodegradable male fastener member shown in FIG. 5.

FIG. 7 illustrates the essential part of an apparatus appropriate for the production of the male fastener member 1*a* of the second embodiment mentioned above.

The apparatus illustrated in FIG. 7 resembles the apparatus shown in FIG. 3 in basic structure. It, however, differs therefrom in respect that the arced face 22*a* of the lower part of the injection nozzle 20*a* is formed in a uniform smooth face, that the circumferential faces of component annular plate members of the die wheel 40*a* have an overall contour such that a multiplicity of cavities 41*a* corresponding to the engaging elements 3*a* and the reinforcing ribs 4*a* of the male fastener member la shown in FIG. 5 may be formed wholly on the circumferential faces of the superposed annular members, and that a groove forming roll 43, on the circumferential face of which protruding parts 44 conforming in shape with the grooves 5*a* on the reverse side of the base part 2*a* are formed as spaced at a prescribed interval, is disposed below the die wheel 40*a* across a prescribed gap equaling the thickness of the base part 2*a* of the male fastener member 1*a*.

By this apparatus, part of the molten biodegradable resin 30 injected from the injection orifice 24 of the injection nozzle 20*a* into the gap between the injection nozzle 20*a* and the die wheel 40*a* fills the cavities 41*a* sequentially to form the hooked engaging elements 3*a* and the reinforcing ribs 4*a* and, at the same time, to form the base part 2*a* of the shape of a flat plate having prescribed thickness and width. Further, while the resin remains in the softened state or partly molten state, the protruding parts 44 on the groove forming roll 43 form the lateral grooves 5*a* on the reverse side of the base part 2*a*. Though the groove forming roll 43 is depicted as separated from the injection nozzle 20*a* in the drawing, it is preferred to be disposed as closely to the injection nozzle as permissible. The groove forming roll 43, when necessary, may be disposed at a position to be produced by partly cutting away the lower part of the leading end of the injection nozzle 20*a*, for example. In FIG. 7, only the cavities 41*a* that correspond to the hook pieces 8 on one side of the hooked engaging elements 3*a* are shown for the sake of convenience.

Thus, the biodegradable male fastener member 1*a* in an elongate shape as shown in FIG. 5 is continuously manufactured with high productivity.

Figure 8:
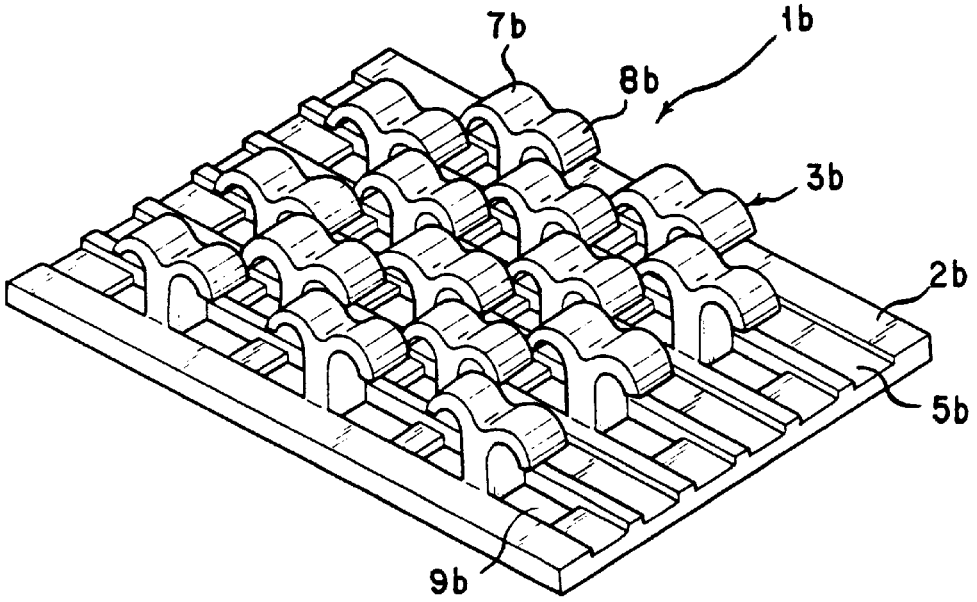
FIG. 8 is a perspective view of a biodegradable hook type separable fastener as the third embodiment of the present invention.
Figure 9:
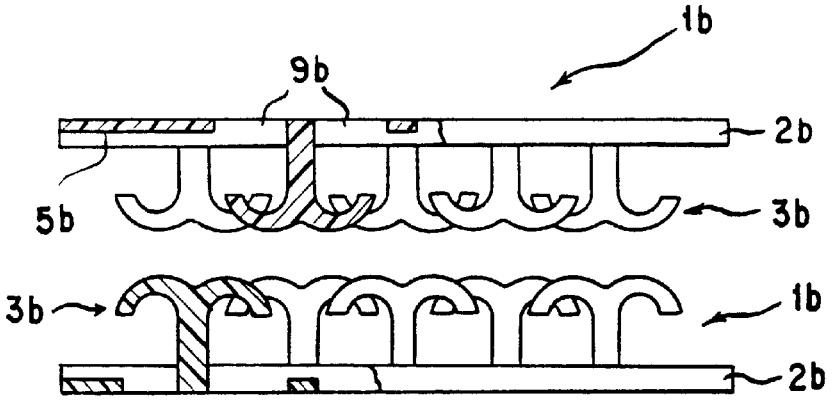
FIG. 9 is a partially cutaway side view illustrating a method for engagement of the biodegradable hook type separable fastener shown in FIG. 8.

FIG. 8 and FIG. 9 illustrate the third embodiment of the biodegradable separable fastener of the present invention, i.e. a ribbon-like separable fastener 1*b* which is composed of identical male and female fastener members.

Though the separable fastener 1*b* is identical with those of the embodiments mentioned above in respect that the base part 2*b* and the multiplicity of engaging elements 3*b* are integrally molded with a biodegradable resin, it is different therefrom in respect that the engaging elements 3*b* are each provided with a head part formed of a pair of hook pieces 7*b* and 8*b* projected in an arced shape toward the opposite sides, that a multiplicity of grooves 5*b* are formed in the longitudinal direction on the upper side of the base part 2*b* at the positions seating the engaging elements 3*b*, and that holes 9*b* are formed in the grooves 5*b* on the opposite sides of the engaging elements 3*b*. The formation of the grooves 5*b* and the holes 9*b* in the base part 2*b* of the separable fastener 1*b* can facilitate the biodegradation by microorganisms and, at the same time, impart proper flexibility and strength to the separable fastener. Since this separable fastener 1*b* is provided with a multiplicity of engaging elements 3*b* each composed of a pair of hook pieces 7*b* and 8*b* projecting toward the opposite sides, the hook pieces of one fastener member can engage the hook pieces of the other fastener member when these two fastener members are laid one over the other in such a manner that the engaging elements thereof may confront each other.

The separable fastener 1*b* of the present embodiment can be molded by injecting the biodegradable resin into a cavity to be defined by an upper and a lower die having a cavity of a prescribed shape.

The separable fastener 1*b* of the present embodiment, unlike those of the embodiments described above, is molded in the shape of a ribbon (one-piece product) of a prescribed area. Where a wide area stands in need of a fastening, therefore, a multiplicity of such separable fasteners 1*b* are used as arrayed adjacently.

Figure 10:
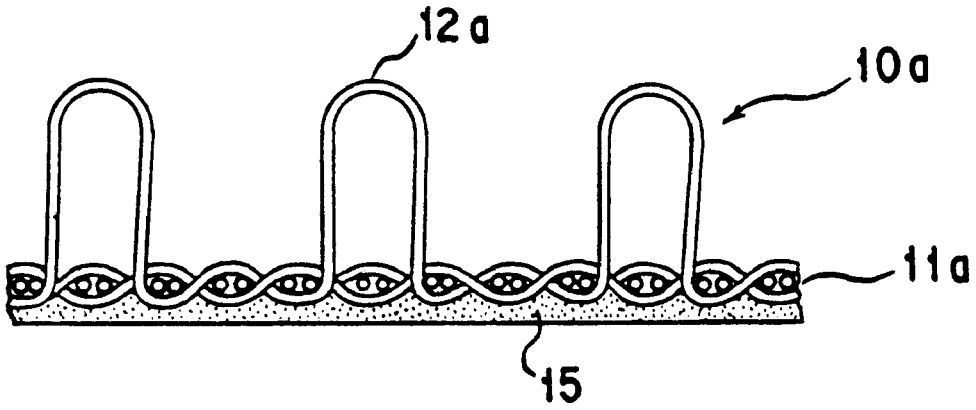
FIG. 10 is a fragmentary cross section of a biodegradable female fastener member as the fourth embodiment of the present invention.
Figure 11:
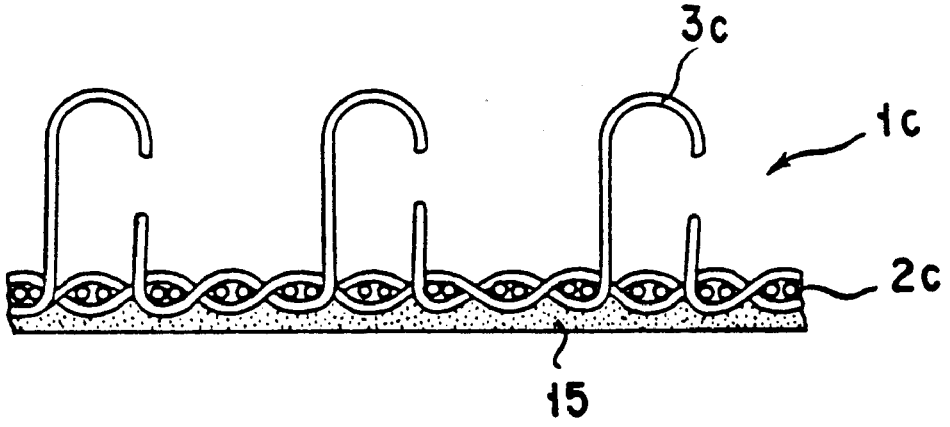
FIG. 11 is a fragmentary cross section of a biodegradable male fastener member as the fourth embodiment of the present invention.

FIG. 10 and FIG. 11 illustrate the fourth embodiment of the biodegradable separable fastener of the present invention, i.e. a separable fastener which is manufactured by preparing monofilaments or multifilements of a biodegradable resin and interweaving them.

In a female fastener member 10*a* shown in FIG. 10, pile yarns formed of biodegradable resin filaments are interwoven in a pile pattern into a base part (base fabric) 11*a* produced by plain weaving biodegradable resin filaments so as to give rise to looped female engaging elements 12*a* which protrude from the obverse side of the base part 11*a*. A male fastener member 1*c* shown in FIG. 11 is identical in structure with the female fastener member 10*a* mentioned above excepting that the loops are partially cut to form hooked engaging elements 3*c*.

A back coat 15 formed of either a water-soluble resin or a biodegradable resin and adapted to prevent the woven yarns from being frayed is applied to the reverse side of the female fastener member 10*a* and the male fastener member 1*c*. When the back coat 15 is manufactured with a water-soluble resin, it is allowed, on being moistened with water, to function as an adhesive layer. When the separable fasteners 1*c* and 10*a* constructed as described above are discarded, they have no possibility of posing the problem of pollution with waste because the parts (2*c*, 3*c*, 11*a*, and 12*a*) made of the biodegradable resin are disintegrated by the action of microorganisms and the back coat 15 made of the water-soluble resin is completely dissolved as by rainwater. Further, when the back coat 15 of the water-soluble resin is completely dissolved, the base parts 11*a* and 2*c* are turned into naked woven textures of biodegradable resin filaments abounding in voids and quickly undergo biodegradation produced by the microorganisms.

Figure 12:
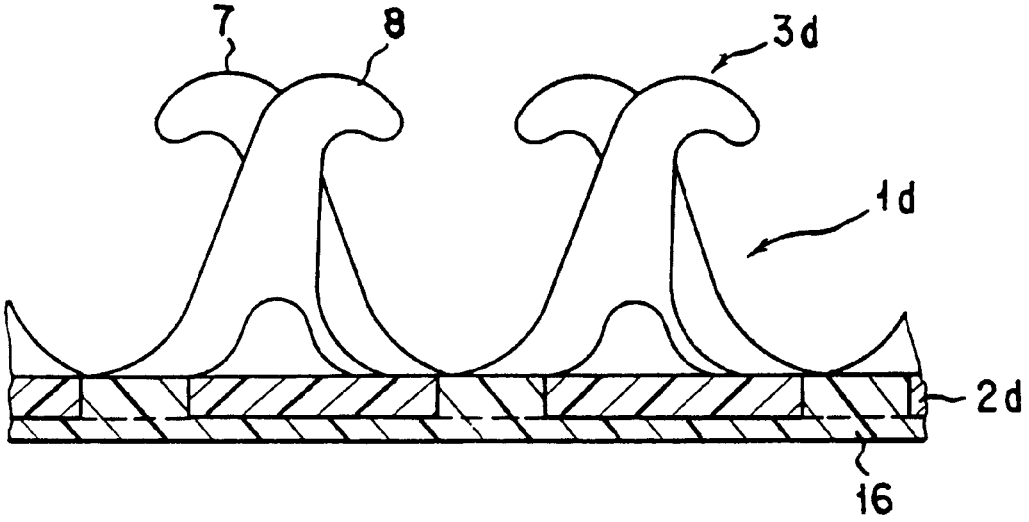
FIG. 12 is a fragmentary cross section illustrating the state of lamination of a water-soluble resin on the reverse side of a biodegradable male fastener member as the fifth embodiment of the present invention.
Figure 13:
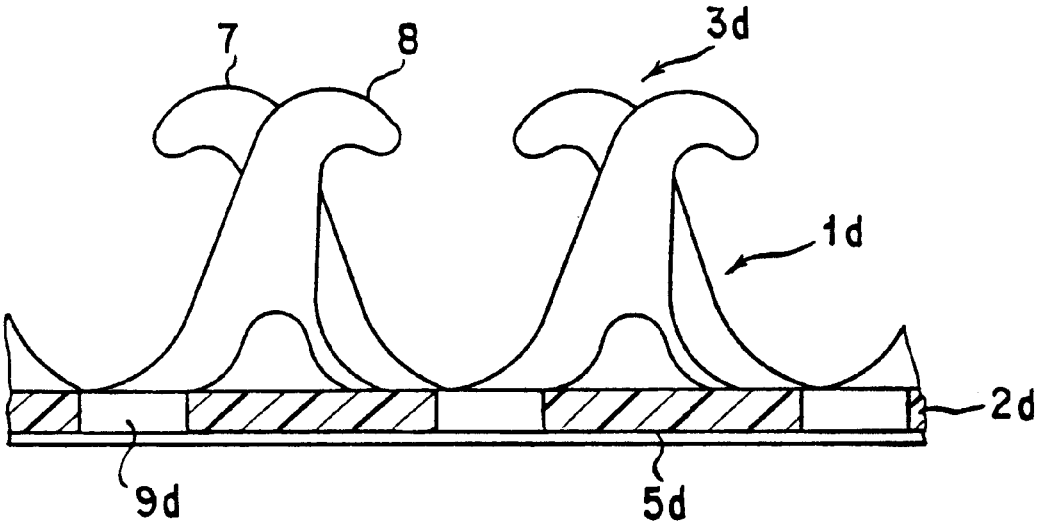
FIG. 13 is a fragmentary cross section illustrating the biodegradable male fastener member as the fifth embodiment of the present invention.

FIG. 12 and FIG. 13 illustrate the fifth embodiment of the present invention, i.e. one example of the method for the formation of holes and grooves in the base part of the separable fastener owing to the dissolution of the water-soluble resin in a solvent. Engaging elements 3*d* of a separable fastener 1*d* are identical in shape with those of the embodiment illustrated in FIG. 5.

In this case, by molding parts of the engaging elements 3*d* and a base part 2*d* of the fastener member 1*d* with a biodegradable resin and the parts of the base part intended to form the holes and the grooves with the water-soluble resin 16 and then immersing the molded product in a solvent such as water or an aqueous alcohol solution thereby inducing dissolution of the water-soluble resin 16, the fastener member 1*d* which has holes 9*d* and grooves 5*d* formed in the base part 2*d* as illustrated in FIG. 13 will be obtained.

The fastener member 1*d* which has the water-soluble resin 16 superposed on the rear side of the base part 2*d* as illustrated in FIG. 12 may be used in its unmodified state. In this case, the water-soluble resin 16, when moistened with water, functions as an adhesive layer. When the fastener member 1*d* which is constructed as described above is discarded, the biodegradation by microorganisms proceeds quickly thereon because the water-soluble resin 16 is completely dissolved as by rainwater and, as a result, the holes 9*d* and the grooves 5*d* are caused to emerge in the fastener member 1*d* made of the biodegradable resin.

The separable fastener 1*d* which is constructed as illustrated in FIG. 12 can be formed by preparing a water-soluble resin film having formed in advance thereon such protruding parts or ridges as conform with the holes and the grooves and pressing the water-soluble resin film fast against the rear side of the fastener member which is formed of a biodegradable resin and is still in a partly molten state.

Figure 14:
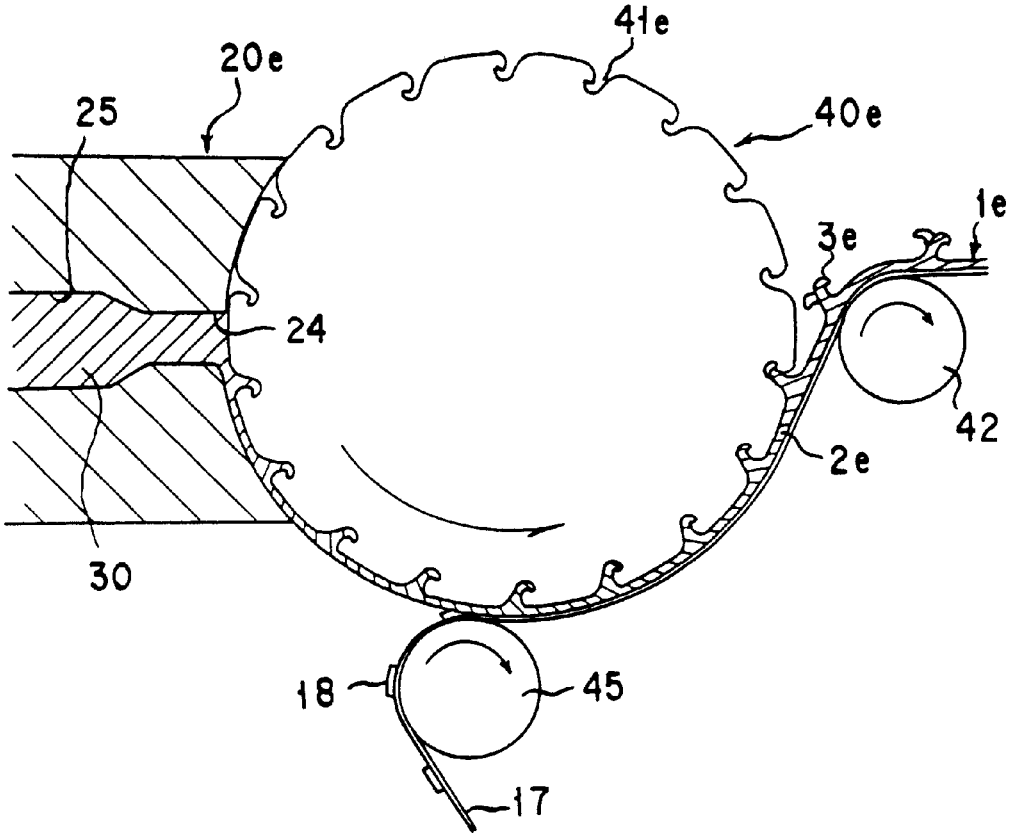
FIG. 14 is a schematic cross section of the essential part of another molding apparatus for the biodegradable male fastener member of the present invention.

One example of this method of formation will be described below with reference to FIG. 14. The formation of a fastener member 1*e* made of a biodegradable resin is accomplished by continuously injecting the molten biodegradable resin 30 through the injection orifice 24 of an injection nozzle 20*e* onto a die wheel 40*e* having cavities 41*e* of prescribed cross sections formed on the peripheral face thereof. The basic structure and operation of the molding apparatus are identical with those of the apparatus illustrated in FIG. 3 and FIG. 7 and will be omitted from the following description.

In the lower part of the molding apparatus, the press roll 45 is closely disposed to an injection nozzle 20*e* and adapted to press the water-soluble resin film 17 having the protruding parts 18 of a prescribed shape formed preparatorily thereon as spaced at a prescribed interval so fast against a base part 2*e* of a fastener member 1*e* freshly molded and still remaining in a partly molten state or softened state that the protruding parts 18 may be buried therein. The fastener member 1*e* to which the water-soluble resin film 17 has been attached fast as described above is gradually cooled and solidified while it is being revolved in conjunction with the die wheel 40*e*, with the result that the fastener member 1*e* integrated with the water-soluble resin film 17 will be continuously formed. Subsequently, by causing the water-soluble resin film 17 to be dissolved out by immersion in a proper solvent such as water or an aqueous alcohol solution, the fastener member which has formed therein such holes as conform in shape with the protruding parts 18 of the water-soluble resin film 17 is obtained. By having ridges conforming in shape with the grooves formed in advance on the obverse side of the water-soluble resin film 17, the fastener member is enabled to form thereon the grooves which correspond to the ridges.

Optionally, a guide path for the water-soluble resin film 17 may be provided inside the injection nozzle 20*e* below the molten resin flow path 25 and the lower part of the injection nozzle on the outlet side of the guide path may be partly cut away to afford a seat for the press roll 45.

Figure 15:
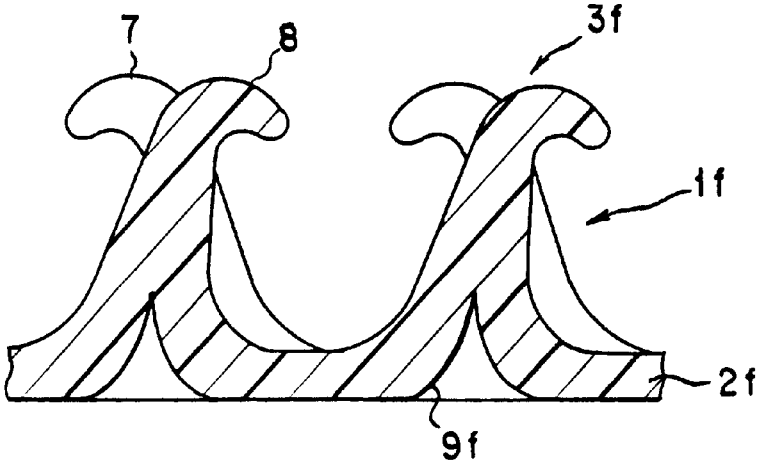
FIG. 15 is a fragmentary cross section of a biodegradable male fastener member as the sixth embodiment of the present invention.

FIG. 15 illustrates the sixth embodiment of the separable fastener of the present invention.

A fastener member 1*f* of the present embodiment is provided with holes 9*f* extending from a base part 2*f* through engaging elements 3*f* and consequently enabled to acquire still higher flexibility and accelerate the biodegradation by microorganisms. The formation of these holes 9*f* can be carried out by the same method as illustrated in FIG. 14. Specifically, this method comprises preparing the water-soluble resin film having formed thereon acute protruding parts conforming in shape with the holes 9*f* mentioned above, pressing the water-soluble resin film into fast adhesion with the fastener member 1*f* freshly molded and still remaining in the partly molten state or softened state in such a manner that the protruding parts may be buried therein, then allowing the fastener member to cool and solidify, and thereafter causing the water-soluble resin film to dissolve out into a proper solvent.

As another example of the method for forming such holes and/or grooves as mentioned above, the method which comprises preparing the water-soluble resin film having formed thereon such protruding parts and/or ridges as correspond to the holes and/or the grooves, disposing the water-soluble resin film in the cavity of the lower die, and molding the fastener member with a biodegradable resin by utilizing the water-soluble resin film as the cavity face of the lower die may be adopted.

Figure 16:
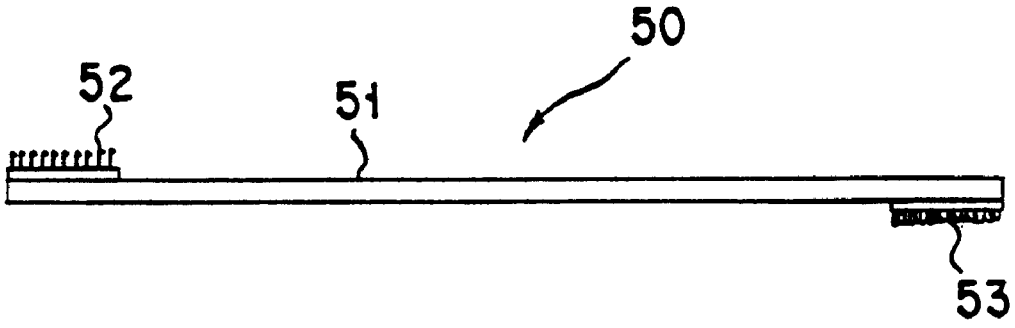
FIG. 16 is a side view of a cover for seedling which uses the biodegradable separable fastener of the present invention.
Figure 17:
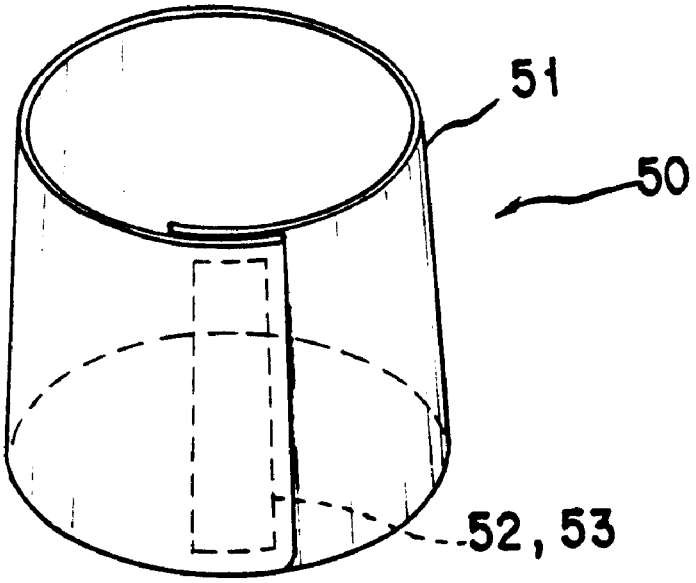
FIG. 17 is a perspective view illustrating the state of assembly of the cover for seedling which is shown in FIG. 16.

FIG. 16 and FIG. 17 illustrate an example of the application of the biodegradable separable fastener of the present invention to a cover for a seedling.

A seeding cover 50, as shown in FIG. 16, comprises a biodegradable resin film 51 and a male fastener member 52 and a female fastener member 53 respectively fixed to the upper and the lower side at the opposite end parts thereof.

This fixation is preferred to resort to such means as the adhesion by the use of a water-soluble resin adhesive agent or the sewing by the use of a yarn made from a biodegradable resin or a water-soluble resin.

The seedling cover 50 is assembled as illustrated in FIG. 17 by pressing the male fastener member 52 and the female fastener member 53 fixed at the opposite end parts of the biodegradable resin film 51 against each other until fast contact.

Then, separable fasteners manufactured from biodegradable resins were tested for peel strength and shear strength. The results of the test are shown in the Table herein below.

By the use of an apparatus constructed as illustrated in FIG. 3, a male biodegradable fastener member, 0.3 mm in base part thickness and 25 mm in width, depicted in FIG. 1 was manufactured from a biodegradable resin (produced by Showa Highpolymer Co., Ltd. and marketed under trademark designation of "Bionolle #3001") under the conditions of an injecting device temperature of 190–210° C. and a molding device temperature of 185° C. For comparison, a male fastener member of the same shape and size as mentioned above was made from low-density polyethylene (LDPE; produced by Mitsubishi Chemical Co., Ltd. and marketed under product code of "LF685").

The male fastener members manufactured as described above were each joined to a female fastener member (25 mm in width) manufactured by weaving nylon yarns and tested for peel strength (180 degree separation) and shear strength. The samples thus produced were each subjected to 1000 engagement-separation cycles in accordance with the durability test specified in JIS (Japanese Industrial Standard) L-3416-1988 and then tested for peel strength and shear strength. As concerns the results of both the peel strength and the shear strength, the numerical values of the initial strength were averages each obtained of five samples and those of the strength after 1000 engagement-separation cycles were averages each obtained of four samples.

TABLE

| Material used for male fastener member | | Biodegradable resin (Bionolle #3001) | LDPE (Mitsubishi LDPE LF685) |
|---|---|---|---|
| Peel strength (g) at room temperature | Initial | 84 | 110 |
| | After 1000 cycles of durability test (JIS L-3416-1988) | 125 | 140 |
| Shear strength (kg) at room temperature | Initial | 11.6 | 12.1 |
| | After 1000 cycles of durability test (JIS L-3416-1988) | 14.5 | 14.9 |

It is clear from the Table that the biodegradable separable fasteners of the present invention possessed fully satisfactory durability.

While certain specific embodiments and working examples have been disclosed herein, the invention may be embodied in other specific forms without departing from the spirit or essential characteristics thereof. The described embodiments and examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A separable fastener comprising a base part and a multiplicity of engaging elements raised from the obverse side of said base part, said base part having at least a portion formed by a molded plate, said molded plate of said base part defining a recess extending from an outer surface of said base part into said base part, said base part and said engaging elements being formed of a biodegradable resin.

2. The separable fastener according to claim 1, wherein at least said base part has a cross-sectional shape such as to give a large specific surface area to said base part.

3. The separable fastener according to claim 1, which comprises holes formed in at least said base part.

4. The separable fastener according to claim 3, wherein said holes are formed by molding with a die.

5. The separable fastener according to claim 3, wherein said holes are formed by the dissolution of a water-soluble resin.

6. The separable fastener according to claim 5, wherein said water-soluble resin is selected from the group consisting of polyvinyl alcohol, modified polyvinyl alcohol, polyacrylic acid, polyethylene oxide, carboxymethylcellulose, and gum.

7. The separable fastener according to claim 3, wherein said holes are extended from the reverse side of said base part through the interiors of said engaging elements.

8. The separable fastener according to claim 1, wherein said base part has a plurality of grooves extending in the longitudinal direction thereof.

9. The separable fastener according to claim 1, wherein said base part has a plurality of grooves extending in the lateral direction thereof.

10. The separable fastener according to claim 1, wherein said base part is a fabric having a back coating layer of a water-soluble resin.

11. The separable fastener according to claim 10, wherein said water-soluble resin is selected from the group consisting of polyvinyl alcohol, modified polyvinyl alcohol, polyacrylic acid, polyethylene oxide, carboxymethylcellulose, and gum.

12. The separable fastener according to claim 1, which comprises grooves formed in at least said base part.

13. The separable fastener according to claim 12, wherein said grooves are formed by molding with a die.

14. The separable fastener according to claim 12, wherein said grooves are formed by the dissolution of a water-soluble resin.

15. The separable fastener according to claim 1, wherein said base part is a fabric having a back coating layer of a biodegradable resin.

16. The separable fastener according to claim 1, wherein said base part is formed entirely by said molded plate.

17. The separable fastener according to claim 1, wherein said base part further comprises a woven portion attached to said molded plate.

18. The separable fastener according to claim 1, wherein said biodegradable resin is selected from the group consisting of a copolymer of hydroxybutyric acid with hydroxyvaleric acid, a blend of starch with modified polyvinyl alcohol, a blend of starch with a biodegradable synthetic polymer, an aliphatic polyester, polycaprolactone, and polylactic acid.

* * * * *